United States Patent [19]

Hall et al.

[11] 4,001,554

[45] Jan. 4, 1977

[54] MODE CONTROL COMPUTER INTERFACE

[75] Inventors: Kilmer L. Hall, Decatur; Allen E. Davis; Robert L. Peck, both of Huntsville, all of Ala.

[73] Assignee: The United States of America as represented by the Secretary of the Army, Washington, D.C.

[22] Filed: Oct. 29, 1975

[21] Appl. No.: 626,681

[52] U.S. Cl. ..... 235/150; 235/184; 318/591; 340/147 R

[51] Int. Cl.[2] ..... G06G 7/48

[58] Field of Search ..... 235/150.5, 150.4, 193, 235/184, 150, 153 AE; 340/147 R, 147 B, 147 C, 147 CV, 147 MT, 146.1 BE, 146.1 C; 318/590, 591, 562, 563

[56] References Cited

UNITED STATES PATENTS

| | | | |
|---|---|---|---|
| 3,243,582 | 3/1966 | Holst | 235/150.4 |
| 3,476,922 | 11/1969 | Yiotis | 235/153 AE |
| 3,480,769 | 11/1969 | Gilbert | 235/150.5 |
| 3,576,535 | 4/1971 | Turner | 318/591 X |
| 3,634,830 | 1/1972 | Baskin | 340/172.5 |
| 3,761,689 | 9/1973 | Watanabe et al. | 235/150.5 |

*Primary Examiner*—Joseph F. Ruggiero
*Attorney, Agent, or Firm*—Nathan Edelberg; Robert P. Gibson; Fred M. Bush

[57] ABSTRACT

In simulation equipment which performs the function of signal processing and sensor systems simulation for in-depth analysis of critical parameters and systems response, a mode control interface allows a single operator of simulation equipment to remotely control the modes of several analog simulators or analog computers, either manually or automatically. Diode transistor logic is used in developing selected logic functions for controlling the proper mode of operation of simultaneously activated simulated systems.

5 Claims, 4 Drawing Figures

MODE CONTROL COMPUTER INTERFACE

DEDICATORY CLAUSE

The invention described herein may be manufactured, used, and licensed by or for the Government for governmental purposes without the payment to us of any royalties thereon.

SUMMARY OF THE INVENTION

The mode control computer interface provides high speed and efficient operation of slave computers in response to automatic or manually activated mode control signals from a master computer. The interface allows real-time simulation of systems to occur simultaneously in plural computers in response to control signals from only one of the computers. The mode control interface is coupled between selected data gating points in the master computer and correspondiing gating points in the slave computers, such that the slave computers are in a standby or free state until accessed through the interace. This allows the master computer to be operated with or without the slave computers operating. The mode control interface uses diode transistor logic to develop the logic functions for selecting the proper mode of the slave computers.

DESCRIPTION OF THE PREFERRED EMBODIMENT

Figure 1:
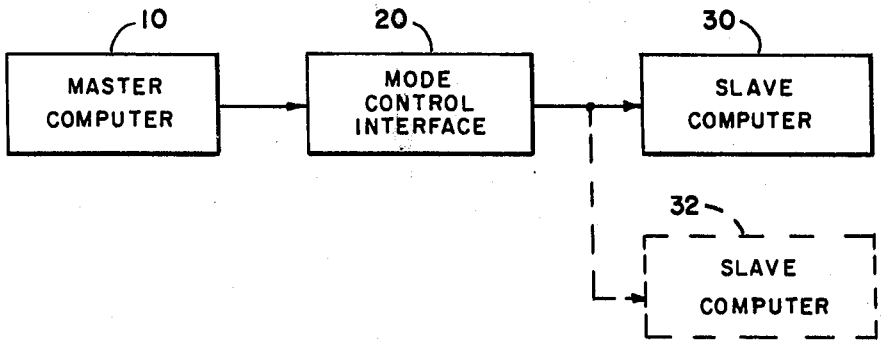
FIG. 1 is a simplified block diagram of the mode control computer interface coupled between two computers.
Figure 2:
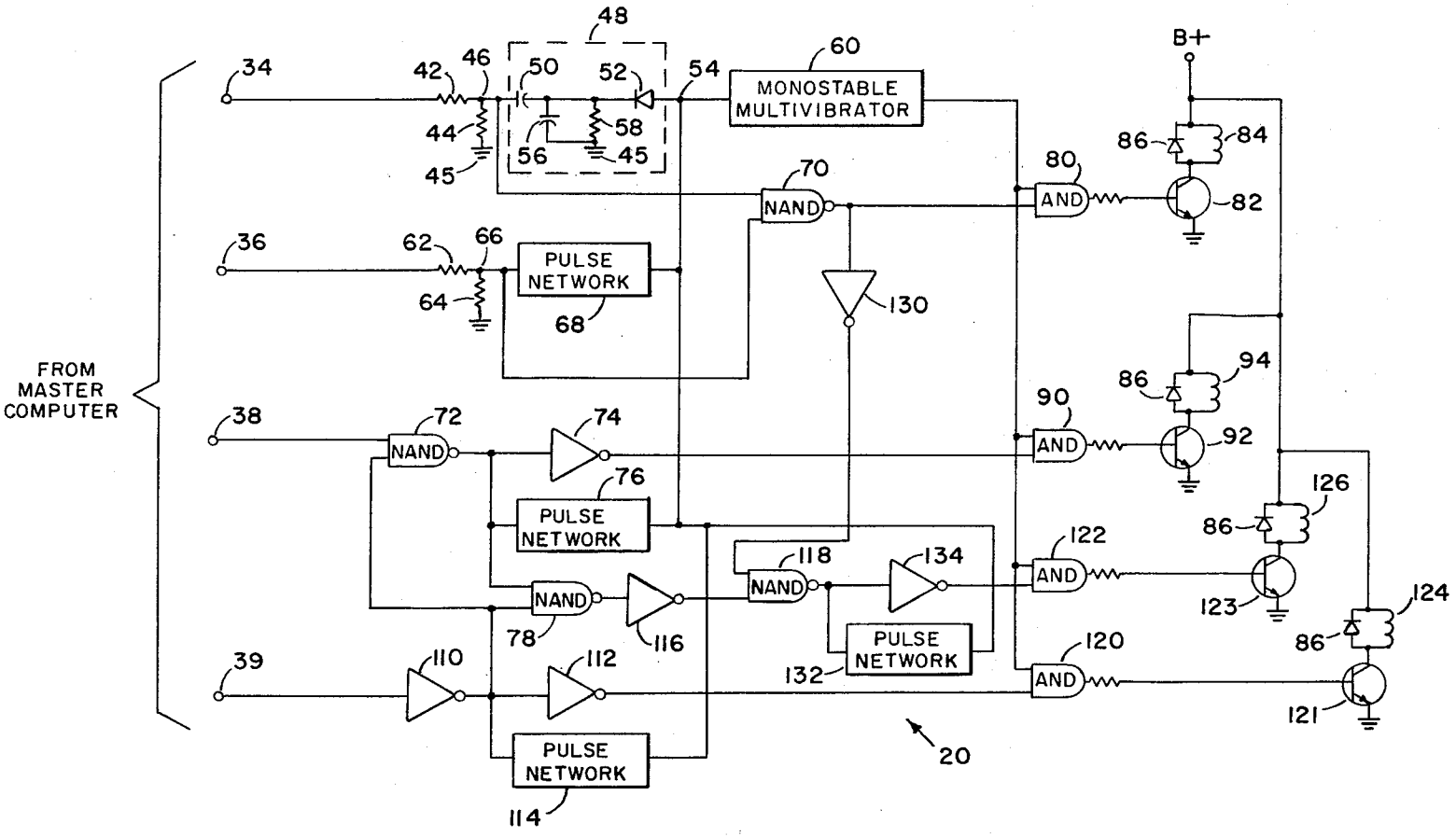
FIG. 2 is a partial schematic and partial block diagram of the mode control interface for a preferred embodiment of the invention.

Referring now to the drawings, FIGS 1 and 2 disclose a preferred embodiment of the invention. The simplified block diagram of FIG. 1 discloses a master computer 10 having outputs coupled to a mode control interface 20. Mode control interface 20 is disclosed having outputs coupled to a slave computer 30 and with additional outputs coupled to additional slave computers 32 if desired. The outputs coupled to slave computer 32 may be identical with the outputs coupled to slave computer 30 or may be separate and distinct to allow the slave computers to be selected simultaneously or selectively.

The mode control interface allows an operator of the master computer to control the modes of another analog simulator or analog computer either manually or automatically from the console of the master computer. Complete mode control of the slave computer is realized with a direct mode to mode control or with one or more modes of the master computer controlling a single mode in the slave computer. As shown in FIG. 2 mode control interface 20 is responsive to control signals from the master computer which are brought to input terminals 34, 36, 38, and 39 of the mode control interface. If the diode transistor logic (DTL) of interface 20 is compatible with the output logic levels of the master computer, signals coupled to the input terminals may be directly coupled to the logic circuitry. If the input logic levels must be reduced for compatibility a typical reduction circuit such as the resistance network comprising resistors 42 and 44 may be coupled as between terminal 34 and ground 45 to protect the interface operating circuitry. An output signal from the resistance network is coupled from terminal 46 to a pulse network 48. Pulse network 48 includes a series capacitor 50 and diode 52 having the anode coupled to an output terminal 54 of the pulse network. A capacitor 56 and resistor 58 are connected in parallel between the cathode of diode 52 and the system ground 45. The output at terminal 54 is coupled as an input signal to a monostable multivibrator 60. In response to appropriate input signals the monostable multivibrator produces a pulse output of an established time duration. A NAND gate 70 has a first input thereof coupled to terminal 46 for receiving respective high or low signals present thereon. Output signals from multivibrator 60 and gate 70 are coupled respectively as inputs to an AND gate 80. Output signals from AND gate 80 are resistively coupled to a transistor switch 82 for activating or deactivating the switch. Similarly input terminal 36 is coupled through a resistance network comprising resistors 62 and 64 to system ground with the network output terminal 66 being coupled to provide an input signal to pulse network 68 and a second input to NAND gate 70. The output from pulse network 68 is coupled to terminal 54 for gating the multivibrator.

Input terminal 38 is shown coupled directly to a NAND gate 72. An output from gate 72 is coupled through an inverter 74 to an input of an AND gate 90. The output of gate 72 is further coupled through a pulse network 76 to terminal 54 for providing an input pulse to multivibrator 60; the output of gate 72 is further coupled as an input to a NAND gate 78.

Input terminal 39 is coupled as an input to an inverter 110. The output of inverter 110 is coupled as a second input to NAND gate 72, as a second input to NAND gate 78, and as inputs to an inverter 112 and a pulse network 114. The output of pulse network 114 is coupled to terminal 54 for providing an input to monostable multivibrator 60, and the output of inverter 112 is coupled directly to an AND gate 120. The output of NAND gate 78 provides an input signal for an inverter 116 and the output of inverter 116 is coupled to provide an input signal to NAND gate 118 NAND gate 118 has a second input coupled from the output of gate 70 through an inverter 130. The output of gate 118 is coupled as an input to a pulse network 132 and as the input of an inverter 134. The output of inverter 134 is coupled directly to an AND gate 122 and the output of pulse network 132 is coupled to terminal 54 to provide an additional input source for multivibrator 60. The output of multivibrator 60 is coupled as an input to respective AND gates 90, 120, and 122.

The output signal from AND gate 90 is resistively coupled to the base of a trigger transistor 92. Similarly AND gate 120 is coupled to transistor 121 and gate 122 is coupled to transistor 123. Transistors 82, 92, 121, and 123 are emitter coupled to ground with the collectors respectively coupled through relays 84, 94, 124, and 126 to a power source B+ for activating the respective relays when the individual switching transistors are turned on. Diodes 86 are connected across each of said relays for reducing spikes in the system during operation of the relays.

Figure 3:
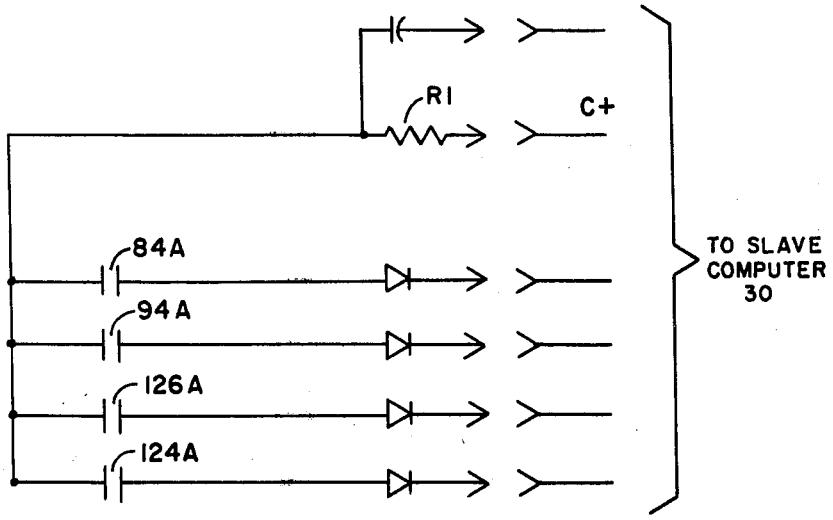
FIG. 3 is the output switching circuits coupled to a slave computer for engaging that computer for mode control.

As shown in FIG. 3 a power source C+ is coupled through resistor R1 to a common side of relay contacts 84A, 94A, 124A, and 126A the other side of these contacts are diode coupled to respective points (not shown) within the slave computer which would normally receive this C+ signal when activated by an operator at the slave computer or at an appropriate time during normal automatic operation of the slave computer.

Figure 4:
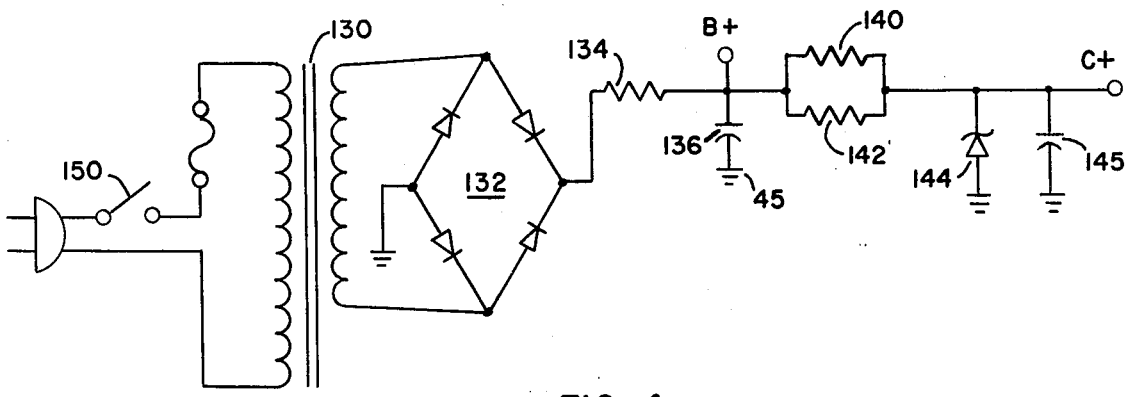
FIG. 4 is the power supply system for the interface circuit.

FIG. 4 discloses a typical transformer 130 and diode quad 132 for rectifying an alternating current input signal to provide a direct current bias voltage for the mode control interface. The output from diode quad 132 is coupled through a resistor 134 to provide the output signal B+ and is coupled through a capacitor 136 to ground 45. Similarly the B+ signal level is further coupled through parallel resistors 140 and 142 to provide other operating voltage levels such as C+ to the mode control interface circuitry. Zenor diode 144 and capacitor 145 regulate the voltage supply. A control switch 150 is connected between the alternating current supply and transformer 130 for activating the mode control interface. This switch may be located on the mode control interface console or on the master computer console as desired. With switch 150 open the master computer and slave computers are effectively isolated from one another and can operate independently. With switch 150 closed, the master computer exercises mode control over the slave computers through the mode control interface.

During operation, when any of the input signals present at terminals 34, 36, 38 or 39 go high, the monostable multivibrator 60 is triggered by a pulse generated from either of pulse networks 48, 68, 76, 114 or 132. Multivibrator 60 produces a pulse of a predetermined width, as for example 50 milliseconds, and supplies this pulse as inputs to AND gates 80, 90, 122, and 120. If a particular AND gate has been enabled which corresponds to a particular mode selected by the master computer, that gate will open allowing the appropriate transistor switch (82, 92, 123, and 121) to be gated on. This provides a closed circuit between B+ and ground through either of relays 84, 94, 126, or 124 and the appropriate transistor switch. As shown in FIG. 3 when the particular relay is energized a voltage C+ is coupled through that relay contact to the slave computer for placing that computer in the proper mode. The particular operating modes are latched within the slave computers. After the output pulse from multivibrator 60 is terminated, the particular AND gate is disabled deactivating the transistor switch and allowing the energized relay to drop out.

In a system wherein a master computer in conjunction with other analog simulator initiating simultaneous simulation computations within the interconnected computer systems, operation may be similar to that wherein a single analog computer, such as the Electronics Associates, Incorporated Model EAI 680 or EAI 690 computer, functions as the master computer and one or more computers such as the Electronics Associates, Incorporated Model EAI 231R computer functions as the slave computer. For this combination of computers input terminal, 39 provides an "initial condition" state wherein the master computer 10 is automatically or mannually commanded to begin a simulation sequence at a preestablished initial point. If a sequence has been started and it is desired to return to the initial condition, an operator controlled impulse to terminal 39 at any time during operation of the simulation circuitry will command the master and slave computers to return to the predetermined initial condition. Any time after the initial condition is established, operation of the computers is controlled by an input signal at terminal 38 indicating "operation" to the slave computers simultaneously with the application of the signal to the master computer. With no further interference the computers will finish the simulation sequence and stop. A "static test" can be introduced at any point in a simulation process through terminal 36. An input signal indicative of a static test stops the simulation circuitry in place and is used when the operator desires to feed test voltages into the computers to check performance of the system. These test voltages are not applied to the system during normal operation. If it is desired to "set the potentiometer" or change the potentiometer coefficient of selected computer circuits during operation of the test or to compare the simulator response to these selected parameters, an input signal at terminal 34 temporarily suspends the simulation sequence. While the particular amplifier output potentiometers are read out or reset to an initial value during this condition, the computer circuits are placed in a stable condition to prevent overload. Respective master and slave computers have circuits well established in the prior art to perform these system related functions. However because these functions are often separate and distinct functions in one computer as compared to combined functions in another computer and may be operated at completely incompatible voltage levels, for simultaneous operation of these computers wherein simulation timing must be the same even though the function may be different, the mode control interface allows simultaneous operation of all slave computers with the master computer when accessed by the operation through operation of the control switch 150.

In mode control operation of an Electronics Associates, Incorporated Model EAI 231R computer as a slave computer from an Electronics Associates, Incorporated Model EAI 680 as a master computer for example, signals from the master computer are brought to the mode control interface at points 34 and 36 which control changes in the potentiometer coefficient and provide for static testing signals. The diode transistor logic integrated circuits of mode control interface 20 have resistive input networks to adapt the input logic level to that of the interface. Operate and initial condition input signals are coupled to terminals 38 and 39 and are compatible with the integrated circuits, thereby requiring no resistive buffer. Since the potentiometer set circuitry of the slave computer utilizes a signal composite equal to the separate potentiometer coefficient and potentiometer set signals as well as static test signals, these input signals will either individually or collectively activate AND gate 80 and relay 84 to initiate the appropriate action within the slaved computer.

Formation of the hold signal output of interface 20 involves gates 78 and 118 along with inverters 116, 130, and 134. When any of the input signals at terminals 34, 36, 38, and 39 go high, monostable multivibrator 60 is triggered by forcing point 54 near ground in response to pulses generated by pulse networks. The hold step allows simulation processes to be temporarily frozen at any instance for measurement data.

Thus for initial condition establishment within the computers at any time during the test, the input at terminal 39 goes high which provides a high input directly and AND gate 120 and simultaneously triggers multivibrator 60 to provide a timed output pulse to gate 120. This activates transistor switch 121 and relay 124 which momentarily applies power to the appropriate computer latching circuit. Once the initial condition is set the input at terminal 39 is allowed to go low which places a low input on AND gate 120, blocking any further activation of relay 124 until the AND gate is again set by an initial condition input signal at terminal 39.

When the input at terminal 39 goes low a high output from inverter 110 is coupled to set NAND gates 72 and 78. Thus, a high input then coupled to input 38 tells the circuit to operate in the predetermined simulation mode to be observed. The high input at terminal 38 enables gate 72 to provide a low output to inverter 74, which provides a high output to set AND gate 90. Simultaneously, pulse network 76 responds to the low output of gate 72 to activate multivibrator 60, thereby providing a timing pulse to enable gate 90. An output from gate 90 momentarily activates transistor 92 and relay 94 to initiate the operating sequence simultaneously in the slave computer.

Any time the inputs at terminals 38 and 39 are both low the outputs of inverter 110 and NAND gate 72 are high, which enables gate 78, resulting in a high input to gate 118 through inverter 116. During this time, if the output from inverter 130 is low, gate 118 prevents the hold circuits controlled by gate 122 from operating. If the output from inverter 130 goes high, NAND gate 118 is enabled allowing pulsing circuit 132 to activate multivibrator 60 while inverter 134 sets gate 122. When gate 122 is enabled relay 121 is activated to initiate the hold condition in the slave computers.

A high input at both terminals 34 and 36 indicates no potentiometer set or potentiometer coefficient or static test condition exists. These high inputs enable gate 70 to provide a low output which blocks gate 80 and also results in a high output from inverter 130 to gate 118. When either of the input terminals 34 and 36 go low, the respective pulse network 48 or 68 activates multivibrator 60 and changes the state of gate 70 to provide a high output to gate 80 for activating relay 84 and the appropriate computer circuit.

Obviously many modifications and variations of the mode control interface are possible in light of the foregoing disclosure. It is therefore understood that within the scope of the appended claims the invention may be practiced otherwise than as specifically described herein.

We claim:

1. In a computer network wherein plural computers must be simultaneously activated and deactivated, the improvement of a mode control interface for providing simultaneous operation of said computers, and comprising: a plurality of control circuits coupled between a first of said computers and other of said computers, each of said control circuits being responsive to a voltage input to provide an isolated voltage output pulse of predetermined time duration; a control switch coupled to said control circuits for providing activating power to said interface; a first of said control circuits being an AND gate having first and second inputs, first and second series connected inverters coupled between the said first computer and said first input of said AND gate, a transistor switch coupled to the output of said AND gate, a relay coupled in series with said transistor and the activating power from said control switch, and a control of said relay coupled to other of said computers for coupling power therethrough when activated by said relay; and a monostable multivibrator having an output connected to the second input of said AND gate for providing a predetermined signal pulse width thereto and having the input thereof coupled between said series connected inverters for receiving an activating pulse therefrom.

2. A mode control interface as set forth in claim 1 wherein a second of said control circuits comprises a second AND gate having first and second inputs, a NAND gate and a third inverter being series connected between the first input of said second AND gate and the first computer, the output of said inverter being coupled to said AND gate input, a first input of said NAND gate being coupled to said first computer and a second input of said NAND gate being coupled to said series connection between the first and second inverters, a second transistor switch coupled to the output of said second AND gate, a second relay coupled in series with said second transistor across said control switch activating power source, and a contact of said second relay for coupling to other of said computers for providing power therethrough when activated by said relay; the junction between said NAND gate and said third inverter being coupled to provide an input pulse to said multivibrator; and the output of said multivibrator being connected to a second input of said second AND gate.

3. A mode control interface as set forth in claim 2 wherein a third of said control circuits comprises a third AND gate; a gating circuit having an input coupled to said first computer and an output coupled to a first input of said third AND gate, a third transistor switch coupled to the output of said thrid AND gate, a third relay coupled in series with said third transistor across the power source from said control switch, and a contact of said third relay for coupling to other of said computers for providing power therethrough when activated by said relay, and a pulse network coupled between the input of said gating circuit and the input of said multivibrator for providing a gating pulse thereto; and the output of said multivibrator being coupled as a second input to said third AND gate.

4. A mode control interface as set forth in claim 3 wherein a fourth of said control circuits comprises a second input of said gating circuit resistively coupled to said first computer for activation thereby and a pulse network coupled between the second input of said gating circuit and the input of said multivibrator.

5. A mode control interface as set forth in claim 4 and further comprising a fourth AND gate having first and second inputs and an output, a fourth transistor switch coupled to the output of said fourth AND gate, a forth relay coupled in series with said fourth transistor across the power source from said control switch, and a contact of said fourth relay disposed for coupling to other of said computers for providing power therethrough when activated by said relay; a second NAND gate having first and second inputs and an output, a fourth inverter coupled between the output of said gating circuit and a first input of said second NAND gate, a fifth inverter coupled between the output of said second NAND gate and the first input of said fourth AND gate, a third NAND gate having a first input coupled to the output of the first NAND gate and having a second input coupled to the second input of the first NAND gate, a sixth inverter coupled between the output of said third NAND gate and the second input of said third NAND gate and the second input of said second NAND gate for selectively activating said second NAND gate and said fourth AND gate only during preselected conditions of said plural control circuits; the output of said second NAND gate being further coupled to provide an input pulse to said multivibrator; and the output of said multivibrator being coupled as a second input to said fourth AND gate.

* * * * *